United States Patent [19]

Grise

[11] Patent Number: 4,749,844

[45] **Date of Patent: * Jun. 7, 1988**

[54] ELECTRICAL HEATER

[76] Inventor: Frederick G. J. Grise, 137 E. Bay Rd., Osterville, Mass. 02655

[ * ] Notice: The portion of the term of this patent subsequent to Sep. 17, 2002 has been disclaimed.

[21] Appl. No.: 865,744

[22] PCT Filed: Aug. 29, 1985

[86] PCT No.: PCT/US85/01661

§ 371 Date: Apr. 30, 1986

§ 102(e) Date: Apr. 30, 1986

[87] PCT Pub. No.: WO86/01672

PCT Pub. Date: Mar. 13, 1986

Related U.S. Application Data

[63] Continuation-in-part of Ser. No. 646,688, Aug. 31, 1984, Pat. No. 4,542,285, which is a continuation-in-part of Ser. No. 580,472, Feb. 15, 1984, abandoned.

[51] Int. Cl.[4] ..... H05B 3/08

[52] U.S. Cl. ..... 219/541; 219/552; 219/528; 338/212

[58] Field of Search ..... 219/543, 528, 212, 541, 219/544, 549, 552; 338/212, 309, 314, 323, 328

[56] References Cited

U.S. PATENT DOCUMENTS 4,542,285 9/1985 Grise ..... 219/543

*Primary Examiner*—E. A. Goldberg
*Assistant Examiner*—Lincoln Donovan

[57] ABSTRACT

A sheet heater including a substrate, a semi-conductor pattern (typically of colloidal graphite) having a pair of spaced-apart conductor contact portions and a heating portion extending between and electrically connected to the contact portions, and a pair of conductors one of which overlies and engages each of the contact portions. Each of the conductors is wider than the respective underlying contact portions of the semi-conductor pattern, and includes a pair of longitudinally-extending strip portions with a central portion including a plurality of longitudinally-shaped openings therebetween. The strip portion at one edge of the conductor overlies and engages a respective contact portion; and a sealing layer of insulating material overlies the respective conductor and is sealed to the substrate along the edges of the conductor and through the longitudinally-spaced openings.

16 Claims, 1 Drawing Sheet

ELECTRICAL HEATER

This application is a continuation-in-part of U.S. application Ser. No. 646,688, filed Aug. 31, 1984, now U.S. Pat. No. 4,542,285, issued Sept. 17, 1985 which it itself is a continuation-in-part of U.S. application Ser. No. 580,472, filed Feb. 15, 1984 now abandoned.

This invention relates to electrical heating devices.

BACKGROUND OF INVENTION

U.S. patent applications Ser. No. 181,974, filed Aug. 28, 1980 and now abandoned, Ser. No. 295,000, filed Aug. 21, 1981 and now U.S. Pat. No. 4,485,297 issued Nov. 27, 1984, Ser. No. 487,080, filed Mar. 23, 1983, now abandoned and Ser. No. 572,678, filed Jan. 20, 1984, now U.S. Pat. No. 4,523,085, issued June 11, 1985 all of which, together with Ser. Nos. 580,742, now abandoned, and 646,688, now U.S. Pat. No. 4,542,285, are owned by the assignee of the present application and are here incorporated by reference, disclose flexible sheet heaters including a pair of longitudinally-extending (typically copper) conductors, and a semi-conductor pattern extending between and electrically connected to the conductors. The heaters there disclosed provide generally superior performance and substantially even heat distribution, and are useful in a wide range of applications.

There are circumstances, however, in which the heater may be subjected to unusual or extreme conditions. For example, Ser. No. 580,472 discloses that heaters may be used as, for example, firing range targets. When used as a target for small arms, there is a very real chance that a bullet may strike and sever one of the longitudinally-extending conductors, and render the heater inoperative. Similarly, the shock of a large calibre shell, when for example the target is used on an anti-tank weapons range, may cause partial delamination or other structural damage, even when the "hit" is wholly in the area between conductors. High stresses or risk of breakage may be presented in other environments or applications; and other potential difficulties are presented by the need, in some applications, to operate using relatively high voltage or current levels.

SUMMARY OF INVENTION

The present invention provides an electrical sheet heater which has greater structural strength and integrity and in which the risk of failure from breaking or cutting of a conductor is significantly decreased. The invention also provides for a higher current carrying capability, and, particularly in those embodiments the semi-conductor pattern between conductors is an essentially solid layer, for more even heat distribution adjacent the inner edges of the conductors.

In general, I have discovered that a sheet heater including a substrate, a semi-conductor pattern (typically of colloidal graphite) having a pair of spaced-apart conductor contact portions and a heating portion electrically connected thereto and extending therebetween, and a pair of conductors one of which overlies and engages each of the conductor contact portions, will provide the above advantages if each conductor includes transversely-spaced, longitudinally-extending strip portions and a plurality of longitudinally-spaced openings therebetween. The strip portion along one edge of each conductor overlies and engages a respective conductor contact portion, and the openings and the strip portion along the other edge of the conductor overlie portions of the substrate that are not covered with the semi-conductor pattern. A sealing layer of insulating material overlies the respective conductor and is sealed to the substrate through the longitudinally-spaced openings.

In preferred embodiments in which the heating portion of the semi-conductor pattern includes a plurality of longitudinally-spaced areas free from semi-conductor material along the inner edge of the conductor and in which the sealing layer is sealed to the substrate in such areas, the conductor includes two rows of longitudinally extending openings, each generally rectangular and not less than about ¼ inch on a side, and there is a solid strip portion about ⅛ wide provided between the two rows of openings and along the inner and outer edges of the conductor. In other preferred embodiments, the conductor includes but a single row of longitudinally-extending openings, there is a solid strip portion about ⅛ inch wide provided along one edge of the row of openings and a solid strip portion about 9/16 inch wide provided along the other edge, and a copper strip about ½ inch wide may underlie the wider solid strip portion (i.e., between the wide strip portion and the substrate in face-to-face engagement with both) to provide even greater current carrying capacity.

DRAWINGS

DETAILED DESCRIPTION

Figure 1:
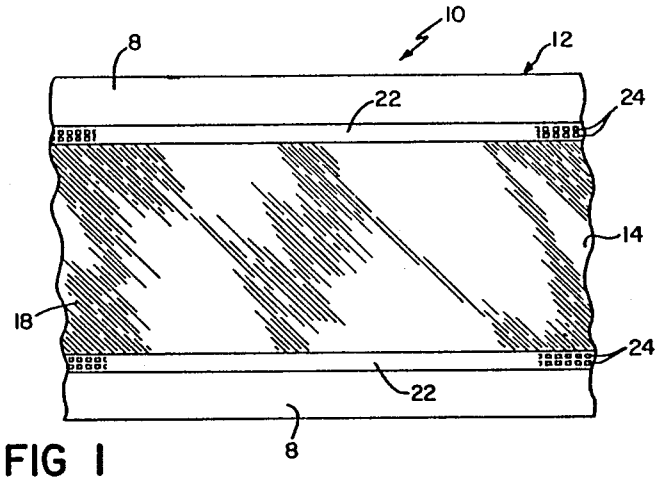
FIG. 1 is a plain view of an electrical heating device embodying the present invention, with the sealing layer removed.

Referring to the drawings, there is shown an electrical sheet heater, generally designated 10, comprising a plastic substrate 12 on which is printed a semi-conductor pattern 14 of colloidal graphite. Uncoated side boundary areas 8, each comprising a strip about 1½ inches wide, extend from the outer side edges of pattern 14 to the side (longitudinal) edges of substrate 12. Substrate 12 is 0.004 inch thick polyester ("Mylar"), and as will be evident from the drawings is essentially transparent. The semi-conductor pattern 14 is printed on the substrate at the thickness required to provide a watt density of about 15 watts per square foot (i.e., at a resistance of about 200 ohms per square); and includes a pair of parallel longitudinal conductor contact portions or "stripes" 16, each 5/32 inch wide and spaced 24 inches apart, and a central or "heating" portion 18 printed over substantially the entire area between stripes 16. The only areas between stripes 16 not so covered are a series of small rectangles 40, each about ⅛ inch in height (measured parallel to stripes 16) and 3/16 inch in width (measured transverse to stripes 16) spaced along the inside of each strip 16. The distance between adjacent rectangles 40 is ¼ inch.

Figure 2:
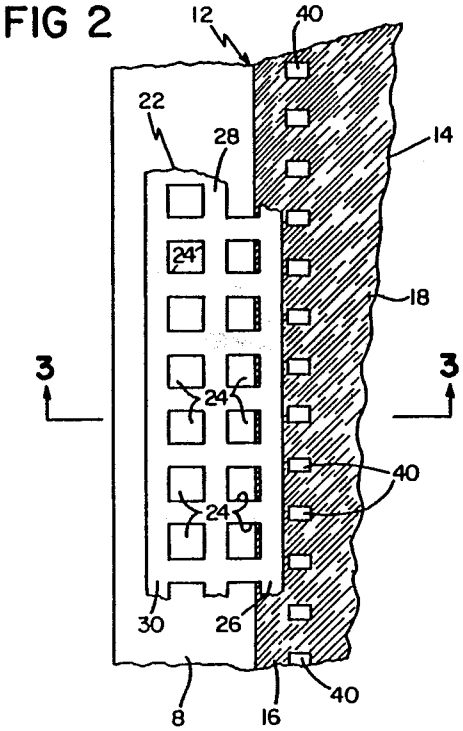
FIG. 2 is a plan view, partially in section and with the top sealing layer removed, of portions of the heater of FIG. 1.

A pair of electrodes 22, each comprising a tinned copper strip 1 inch wide and 0.003 inch thick, extend longitudinally of the heater, one electrode extending along and engaging each of stripes 14. As shown most clearly in FIG. 2 each electrode includes two transversely-spaced, longitudinally-extending rows of spaced square holes 24. Solid copper strips, designated 26, 28 and 30 respectively, are provided along the inner and outer edges of the electrode, and between the two rows of holes 24. In the illustrated embodiment, each hole 24 is 5/16 inch square, each of strips 26, 28 and 30 is ⅛ inch wide, and the space between adjacent holes in each row is also ⅛ inch. As will be apparent, the ⅛ inch width of strip 26 is slightly less than the 5/16 inch width of the semi-conductor stripe 16 which the strip overlies.

Figure 3:
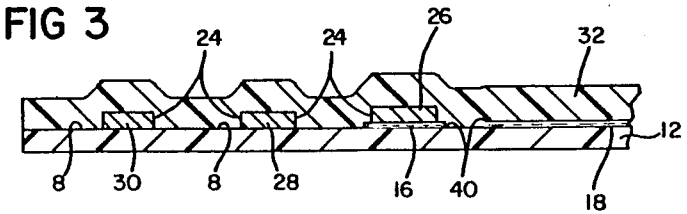
FIG. 3 is a sectional view, taken at 3—3 of FIG. 2, with the sealing layer in place.

A thin plastic cover sheet 32 [shown in FIG. 3 and comprising an essentially transparent co-lamination of an 0.005 cm. (0.002 in.) thick polyester ("Mylar") and an 0.007 cm. (0.003 in.) thick adhesive binder, e.g., polyethylene] overlies substrate 12, semi-conductor pattern 14 and conductors 22. The conductors 22 are not themselves bonded to the underlying substrate or semi-conductor material, and the cover sheet bonds poorly to the semi-conductor pattern. However, the polyethylene forming the bottom layer of cover sheet 32 bonds well to substrate 12. In particular, the cover sheet and substrate are laminated together (as taught in U.S. Pat. No. 4,485,297 and Ser. No. 572,678) and the polyethylene bottom layer of cover sheet 32 bonds the cover sheet tightly the longitudinally-extending, uncoated (with semi-conductor material) areas 8 of substrate 12 between the outside edge of each conductor 22 and the adjacent outside edge of the heater and through the two rows of holes 24 in each conductor 22. Sheet 32 also is bonded to the uncoated (with semi-conductor material) rectangular areas 40 spaced along the inside edge of each conductor 22. Sheet 32 thus holds the conductors 22 tightly in place against the underlying semi-conductor stripes 16. Further, because the substrate 12 and cover sheet 32 are sealed tightly to each other in the areas 8 between the outside edge of conductors 22 and the outer edges of the heater, the unit is essentially hermetically sealed.

It will be noted that, typically, semi-conductor material underlies only one of the longitudinally-extending strip portions of each conductor 22, i.e., interior strip portion 26.

The conductors 22 of the completed heater may be connected to a source of power by any of a variety of connectors, including those discussed in aforementioned U.S. Pat. No. 4,465,297 and application Ser. No. 572,678.

OTHER EMBODIMENTS

Various modifications may be made in other embodiments.

For example, in lieu of a sealing layer overlying substantially the entire substrate 12, a narrow (about 1½ inch wide) strip of polyester tape with an acrylic heating (typically a transparent "Mylar" tape obtained from either 3M Corp. of St. Paul, Minn. or Ideal Tape, Inc. of Lowell, Mass.) may overlie each conductor (but not the major portion of the semi-conductor pattern between conductors) and hold it in tight face-to-face engagement with the underlying substrate and semi-conductor stripe. Each such tape strip should be at least ¼ to ½ inch wider than the conductor, and will be sealed to the substrate along the inside and outside edges of the respective conductor and through the openings in the conductor. In such circumstances the central semi-conductor pattern area not covered with a tape strip typically will be coated with a dielectric, thermally-conductive polyester material, such as can be obtained from Amicon Corp. of Lexington, Mass.

Similarly, the conductor itself may include only a single row of longitudinally-spaced central openings. If, for example, a total conductor width of only about ½ inch is required to provide the necessary current-carrying capacity, the outer row of openings 24 and the outer edge strip portion 30 may be omitted. If greater current-carrying capacity is required, the total 1 inch conductor width may be maintained, but the outer row of openings 24 may be omitted thus providing a solid copper strip about 9/16 inch wide along the outer edge of the conductor 22; and even greater current-carrying capacity may be provided by placing a second thin copper strip (e.g., 0.003 inch thick and about ½ inch wide) under the wide strip at the outer edge of the conductor 22. In all of these embodiments, the inner edge of the conductor 22 is held in tight face-to-face engagement with the underlying semi-conductor stripe by the portions of plastic sheet 32 bonded to the uncoated (with semi-conductor material) portions of substrate 12 through the single row of openings 24 and along the inside edge of conductor 22; and the plastic sheet 32 is also bonded to the uncoated portion of substrate along the outside edge of the conductor.

In still further embodiments, which may employ any of the aforedescribed conductors, the conductors may engage portions of the semi-conductor pattern that are aligned or otherwise non-parallel to each other, and the heating portion of the semi-conductor pattern between the conductors may comprise a plurality of generally-parallel, spaced-apart bars (as disclosed in U.S. Pat. No. 4,485,297) or one or more wide, generally U-shaped, patterns.

Other embodiments will be within the scope of the following claims.

What is claimed is:

1. In a sheet heater including a substrate, a semi-conductor pattern on said substrate having a pair of spaced-apart conductor contact portions and a heating portion electrically connected thereto and extending therebetween, and a pair of conductors one of which overlies and engages each of said conductor contact portions, that improvement wherein:

at least one of the conductors includes a pair of transversely-spaced, longitudinally-extending strip portions and therebetween a central portion including a plurality of longitudinally-spaced openings;

the said strip portion along one edge of the said at least one conductor overlies and engages the respective one of said conductor contact portions; and a sealing layer of insulating material overlies the said at least one conductor and is sealed to said substrate through said longitudinally-spaced openings of said one conductor.

2. The sheet heater of claim 1 wherein the said openings and the said strip portion along the other edge of the said one conductor overlie portions of the substrate that are not covered with the semi-conductor pattern.

3. The sheet heater of claim 1 wherein said sealing layer is sealed to said substrate adjacent said other edge of said one conductor.

4. The sheet heater of claim 1 wherein said semi-conductor pattern is arranged to provide a plurality of longitudinally-spaced areas free from semi-conductor material adjacent said one edge of said one conductor, and said sealing layer is sealed to said substrate in said areas.

5. The sheet heater of claim 1 wherein said conductor has a width greater than that of the respective conductor contact area.

6. The sheet heater of claim 1 wherein said conductor contact areas comprise a pair of parallel-spaced apart longitudinally-extending stripes, each of said conductors has a width greater than of a respective one of said stripes and includes a said strip portion overlying the respective one of said stripes and a central portion including a plurality of longitudinally-spaced openings, and a said sealing layer overlies each of said conductors and is sealed to said substrate adjacent the inner and outer edges of the said conductor and through the said longitudinally-extending openings thereof.

7. The sheet heater of claim 1 wherein said strip portion along said one edge of said one conductor is relatively narrow, and said strip portion along said other edge of said one conductor is relatively wide.

8. The sheet heater of claim 7 wherein said strip portion along said other edge is not less than about four times as wide as said strip portion along said one edge.

9. The sheet heater of claim 1 including a further conductor having a width not greater than that of said strip portion along said other edge of said one conductor underlying said strip portion along said other edge in face-to-face engagement therewith and with said substrate.

10. The sheet heater of claim 1 wherein said strip portions are positioned adjacent the opposite longitudinally-extending edges of said conductors.

11. The sheet heater of claim 1 wherein each of said conductors includes a central strip portion extending longitudinally thereof intermediate and spaced from each of said other strip portions thereof, and including a said central portion intermediate each adjacent pair of said strip portions thereof.

12. The sheet heater of claim 1 wherein said openings are generally rectangular.

13. The sheet heater of claim 1 wherein each of said strip portions is about $\frac{1}{8}$ inch wide and said openings are rectangular and have a width, measured transversely of said conductor, greater than $\frac{1}{8}$ inch.

14. The sheet heater of claim 13 wherein each of said openings is a square not less than about $\frac{1}{4}$ inch on a side.

15. The sheet heater of claim 6 wherein one of said strip portions is positioned adjacent a longitudinally-extending edge of each of said conductors, and has a width not more than about one-fourth the overall width of said each conductor.

16. The sheet heater of claim 1 wherein each of said openings has a width not less than about $\frac{1}{4}$ inch.

* * * * *

UNITED STATES PATENT OFFICE

CERTIFICATE OF CORRECTION

Patent No. 4,749,844 Dated June 7, 1988

Inventor(s) Frederick G. J. Grise

It is certified that error appears in the above-identified patent and that said Letters Patent are hereby corrected as shown below:

On the Title Page:

Related U.S. Application Data

"continuation-in-part of Ser. No. 580,472, Feb. 15, 1984, abandoned." should be -- continuation-in-part of Ser. No. 580,472, Feb. 15, 1984, Pat. No. 4,633,068--

Col. 1, line 8, "No. 580,472, filed Feb. 15, 1984 now abandoned." should be -- No. 580,472, filed Feb. 15, 1984 and now U.S. Pat. No. 4,633,068--

Signed and Sealed this

Fourth Day of October, 1988

*Attest:*

*Attesting Officer*

DONALD J. QUIGG

*Commissioner of Patents and Trademarks*